US005349169A

United States Patent [19]

Ueno et al.

[11] Patent Number: 5,349,169

[45] Date of Patent: Sep. 20, 1994

[54] MICROWAVE OVEN USING A PRECOATED SHEET STEEL AS WALLS OF AN INTERNAL CHAMBER THEREOF

[75] Inventors: Yoshiharu Ueno, Neyagawa; Masahiro Inoue, Nara, both of Japan

[73] Assignee: Sharp Kabushiki Kaisha, Osaka, Japan

[21] Appl. No.: 942,177

[22] Filed: Sep. 9, 1992

[30] Foreign Application Priority Data

Dec. 27, 1991 [JP] Japan ..... 3-346171

[51] Int. Cl.[5] ..... H05B 6/64

[52] U.S. Cl. ..... 219/756; 126/19 R

[58] Field of Search ..... 219/10.55 R, 10.55 E, 219/756; 126/19 R

[56] References Cited

U.S. PATENT DOCUMENTS 3,460,523 8/1969 Stiles et al. ..... 126/19 R
4,084,975 4/1978 Faust ..... 126/19 R

FOREIGN PATENT DOCUMENTS 60-201945 10/1985 Japan .
3-61094 9/1991 Japan .
2170428 8/1986 United Kingdom .

OTHER PUBLICATIONS

Patent Abstract Of Japan, vol. 010, No. 346 (M-537) Nov. 21, 1986 & JP-A-61 147 025 (Matsushita Electric Ind. Co. Ltd.), Jul. 4, 1986.
Patent Abstract Of Japan, vol. 012, No. 312 (C-523) Aug. 24, 1988 & JP-A-63 083 172 (Kansai Paint Co. Ltd.), Apr. 13, 1988.
Patent Abstract Of Japan, vol. 008, No. 035 (M-276) Feb. 15, 1984 & JP-A-58 190 630 (Sharp KK), Nov. 7, 1983.
Patent Abstract Of Japan, vol. 013, No. 204 (M-825) May 15 1989 & JP-A-10 26 438 (Kobe Steel Ltd.) Jan. 27 1989.

*Primary Examiner*—Philip H. Leung
*Attorney, Agent, or Firm*—Birch, Stewart, Kolasch & Birch

[57] ABSTRACT

There is provided a microwave oven using as walls of its internal chamber a precoated sheet steel which has no harmful effect on food sanitation. The precoated sheet steel includes a comprised a sheet steel, a strontium chromate primer having strontium chromate dispersion-mixed with a resin and being applied to one side of the sheet steel, a paint applied over the strontium chromate primer, and a paint applied over the other side of the sheet steel. The one side of the precoated sheet steel constitutes exterior surfaces of the walls of the internal chamber and the other side of the precoated sheet steel constitutes interior surfaces of the walls of the internal chamber. A molybdenum primer comprising molybdenum pigment dispersion-mixed with a resin may be applied to both sides of the sheet steel instead of the strontium chromate primer.

4 Claims, 7 Drawing Sheets

Fig. 6

| Material Composition | Compounding Ratio |
|---|---|
| Strontium Chromate | 35wt% |
| Titanium Oxide | 20wt% |
| Extender Pigment | 2wt% |
| Polyester | 38wt% |
| Additive | 5wt% |

Fig. 7

| Material Composition | Compounding Ratio |
|---|---|
| Titanium Oxide | 21wt% |
| Carbon Black | 5wt% |
| Extender Pigment | 2wt% |
| Polyester | 70wt% |
| Additive | 2wt% |

Fig. 8

| Material Composition | Compounding Ratio |
|---|---|
| Zinc Phosphate | 28wt% |
| Iron Oxide Yellow | 3wt% |
| Titanium Oxide | 11wt% |
| Extender Pigment | 2wt% |
| Polyester | 55wt% |
| Additive | 1wt% |

Fig. 9

| Material Composition | Compounding Ratio |
|---|---|
| Titanium Oxide | 18wt% |
| Extender Pigment | 2wt% |
| Tetrafluoro Plastic | 60wt% |
| Polyester | 18wt% |
| Additive | 2wt% |

Fig. 10

| Thickness mm | Test Time (hr.) | | | | |
|---|---|---|---|---|---|
| | 240 | 360 | 500 | 750 | 1000 |
| 0.4 | ○ | ○ | ○ | ○ | ○ |
| 0.5 | ○ | ○ | ○ | ○ | ○ |
| 0.6 | ○ | ○ | ○ | ○ | ○ |
| 0.7 | ○ | ○ | ○ | ○ | △ |
| 0.8 | ○ | ○ | ○ | ○ | △ |
| 1.0 | ○ | ○ | ○ | △ | × |
| 1.2 | ○ | ○ | △ | × | × |
| 1.5 | ○ | △ | × | × | × |
| 2.0 | △ | × | × | × | × |

Fig. 11

| Content wt% | Test Time (hr.) | | | | |
|---|---|---|---|---|---|
| | 240 | 360 | 500 | 750 | 1000 |
| 35 | ○ | ○ | ○ | ○ | ○ |
| 18 | ○ | ○ | ○ | ○ | △ |
| 9 | ○ | ○ | △ | × | × |
| 4 | △ | × | × | × | × |
| 0 | × | × | × | × | × |

| Material Composition | Compounding Ratio |
|---|---|
| Zinc Molybdate | 35 wt% |
| Titanium Oxide | 20 wt% |
| Extender Pigment | 2 wt% |
| Polyester | 38 wt% |
| Additive | 5 wt% |

| Material Composition | Compounding Ratio |
|---|---|
| Zinc Molybdate | 28 wt% |
| Iron Oxide Yellow | 3 wt% |
| Titanium Oxide | 11 wt% |
| Extender Pigment | 2 wt% |
| Polyester | 55 wt% |
| Additive | 1 wt% |

Fig. 15

| Coat Thickness μ | Test Time (hr.) | | | | |
|---|---|---|---|---|---|
| | 240 | 360 | 500 | 750 | 1000 |
| 1 | △ | × | × | × | × |
| 3 | ○ | ○ | △ | × | × |
| 5 | ○ | ○ | ○ | ○ | ○ |
| 7 | ○ | ○ | ○ | ○ | ○ |
| 10 | ○ | ○ | ○ | ○ | ○ |
| 15 | ○ | ○ | ○ | ○ | ○ |

Fig. 16

| Primer Rust Preventive (5 μ each as Primer, Front and Back) | Test Time (hr.) | | | | |
|---|---|---|---|---|---|
| | 240 | 360 | 500 | 750 | 1000 |
| Zinc Molybdate | ○ | ○ | ○ | ○ | ○ |
| Strontium Chromate | ○ | ○ | ○ | ○ | ○ |
| Zinc Oxide | △ | × | × | × | × |
| Epoxy Resin | × | × | × | × | × |
| Polyester | × | × | × | × | × |

MICROWAVE OVEN USING A PRECOATED SHEET STEEL AS WALLS OF AN INTERNAL CHAMBER THEREOF

BACKGROUND OF THE INVENTION

Field of the Invention

The present invention relates to a microwave oven having its internal chamber walls comprised of a precoated sheet steel (PCM sheet steel) of the type in which a chromate resin mixed paint or anticorrosion molybdenum pigment mixed paint is applied as a primer.

Description of the Prior Art

PCM sheet steel requires no post-working painting, and this provides for simplification of the process for product fabrication and eliminates the need for a painting apparatus for post-forming painting. Because of this fact, PCM sheet steel has been receiving considerable attention as a material for use in constructing the internal chamber walls of microwave ovens. Microwave ovens in which PCM sheet steel is used as internal chamber walls of the oven are known including, for example, one described in Japanese Patent Publication No. 3-61094. The PCM sheet steel used in this prior art type of microwave oven has its primer and top coats formed of a polyester resin.

A microwave oven will cause vapor to be generated within the internal chamber thereof upon heating a foodstuff. In this case, if the interior of the internal chamber is filled with vapor, the food in the internal chamber may not be seen from the outside. In order to increase the commercial attractiveness of the microwave oven and/or to enable a user to determine the progress of cooking in the internal chamber of the oven, it is required that the condition of cooking within the internal chamber be clearly visible to the user from the outside. A known type of microwave oven is designed to meet this requirement, being such that the internal chamber of the microwave oven has intake and exhaust vents provided in the walls thereof so that when vapor is produced within the internal chamber the vapor may be exhausted outward in order to enable the food in the internal chamber to be seen clearly from the outside. The intake and exhaust vents generally consist of punch holes each of the order of 3 to 3.5 mm in diameter.

The PCM sheet steel used in the prior art microwave oven has a drawback that its corrosion resistance is rather low because the sheet steel has its primer and top coats formed of a polyester resin. Where the PCM sheet steel is formed with such punch holes as noted above, it is required that the punched-out portion be subjected to post-coating with a resin paint in order to provide improved corrosion resistance. Technically, however, it has hitherto been impracticable to use a paint having good rust-preventing characteristics in view of possible unfavorable effect of such paint upon the hygienic quality of the oven interior.

SUMMARY OF THE INVENTION

The object of the present invention is therefore to provide a microwave oven having its internal chamber walls comprised of a highly corrosion-resistant PCM sheet steel which involves no problem whatever from the standpoints of rust prevention and health even when the walls are formed with punch holes and which requires no post-work painting.

In order to achieve the aforementioned object, there is provided a microwave oven in which walls of an internal chamber of the microwave oven are comprised of a precoated sheet steel, wherein the precoated sheet steel is comprised of a sheet steel, a paint comprising strontium chromate dispersion-mixed with a resin and being applied to one side of the sheet steel as a primer, a paint applied over the primer, and a paint applied over the other side of the sheet steel.

With the above structure, because the primer comprising strontium chromate has high corrosion resistance, the walls of the internal chamber are hard to corrode, thus providing high corrosion resistance for the microwave oven.

It is preferable that the one side of the precoated sheet steel constitutes exterior surfaces of the walls of the internal chamber and the other side of the precoated sheet steel constitutes interior surfaces of the walls of the internal chamber.

Where the walls of the internal chamber are formed with punch holes for air intake and also with punch holes for air exhaust, the temperature and humidity conditions within the internal chamber, in the vicinity of the intake holes, provide a favorable corrosion resistant atmosphere since the temperature and humidity conditions are closer to those in the outside air, whereas both temperature and humidity conditions in the vicinity of the exhaust holes are unfavorably high and present a corrosive environment. By arranging so that one side of the precoated sheet steel constitutes the exterior surface of the walls of the internal chamber and the other side of the precoated sheet steel constitutes the interior surface of the walls of the internal chamber, it is possible to provide for sufficient health safety even if some trace amount of strontium chromate elution occurs in the vicinity of the exhaust holes, because air streams in that location are outward oriented preventing the eluted strontium chromate from entering the interior of the internal chamber. Further, it is difficult for strontium chromate to elute in the vicinity of the intake holes, because the temperature and humidity conditions therein are closer to those in the outside air.

Further, it is preferable that a proportion of strontium chromate in composition of the primer after baking of the primer is not less than 20 wt %.

Then, it is possible to provide satisfactory corrosion resistance that can be maintained even after a long period of operation.

There is provided a microwave oven in which walls of an internal chamber of the microwave oven are comprised of a precoated sheet steel, wherein the precoated sheet steel is comprised of a sheet steel, a paint comprising molybdenum pigment dispersion-mixed with a resin and being applied to both sides of the sheet steel as a primer, and paints applied over the primer of both sides of the sheet steel.

There is provided a microwave oven in which walls of an internal chamber of the microwave oven are comprised of a precoated sheet steel, wherein the precoated sheet steel is comprised of a sheet steel, a paint comprising molybdenum pigment dispersion-mixed with a resin and being applied to one side of the sheet steel as a primer, a paint applied over the primer, and a paint applied over the other side of the sheet steel.

The primer comprising molybdenum pigment dispersion-mixed with a resin is a material having high corrosion resistance and involving no problem from the standpoint of food sanitation. Thus, a microwave whose internal chamber walls are highly corrosion resistant and well adapted to meet the requirements for food sanitation can be provided.

It is preferable that the sheet steel is an iron/zinc alloy plated, surface treated sheet steel.

Further it is preferable that the sheet steel is an iron/-zinc non-alloy plated, surface treated sheet steel.

BRIEF DESCRIPTION OF THE DRAWINGS

The present invention will become more fully understood from the detailed description given hereinbelow and the accompanying drawings which are given by way of illustration only, and thus are not limitative of the present invention, a wherein:

FIG. 6 is a table showing a post-baking composition of the primer on the back side of the PCM sheet steel;

FIG. 7 is a table showing a post-baking composition of top coat paint on the back side of the PCM sheet steel;

FIG. 8 is a table showing a post-baking composition of the primer on the front side of the PCM sheet steel;

FIG. 9 is a table showing a post-baking composition of the top coat paint on the front side of the PCM sheet steel;

FIG. 10 is a table showing anti-corrosion performance test results with respect to PCM sheet steels of various different gauges;

FIG. 11 is a table showing anti-corrosion performance test results with respect to PCM sheet steel with its strontium chromate content varied in different ways;

FIG. 15 is a table showing anti-corrosion performance test results with respect to the PCM sheet steel with its gauge varied in different ways; and FIG. 16 is a table showing anti-corrosion performance test results with respect to the PCM sheet steel with the primer rust preventive material varied.

DETAILED DESCRIPTION OF THE PREFERRED EMBODIMENTS

Embodiments of the invention will now be described in further detail with reference to the accompanying drawings.

First Embodiment

Figure 1:
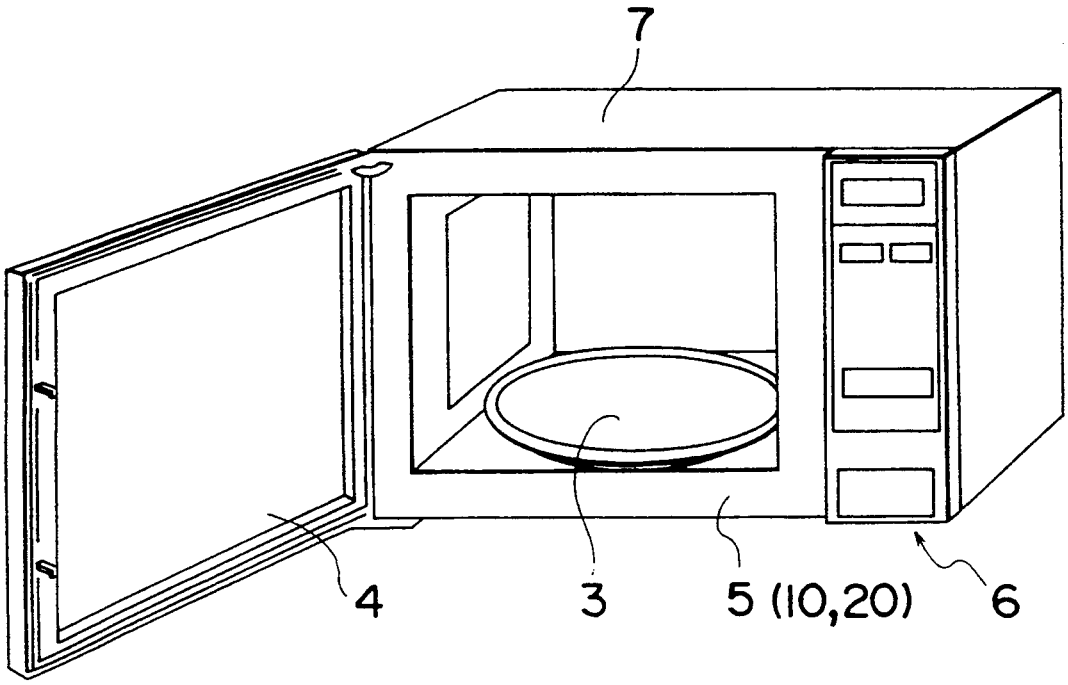
FIG. 1 is a perspective view showing the general appearance of a microwave oven of one embodiment of the invention.
Figure 2:
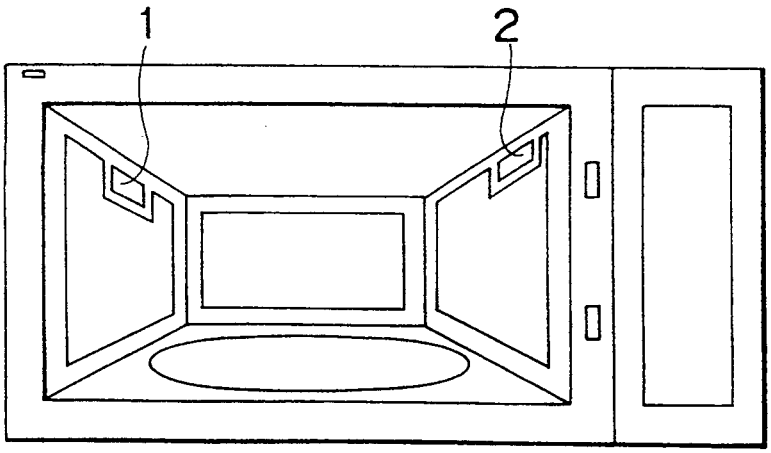
FIG. 2 is a view showing an internal chamber of the microwave oven.

FIG. 1 is a general view of a microwave oven representing the embodiment. In FIG. 1, the microwave oven comprises a turntable 3, a door 4, an internal chamber 5, a control panel 6, and a cabinet 7. The internal chamber 5 has, as shown in FIG. 2, an exhaust vent 1 on one side wall thereof and an intake vent 2 on the other side wall.

The internal chamber 5 is press molded from a PCM sheet steel 10 which conforms to the post-drying paint specifications shown in tables given in FIGS. 6 to 9. FIG. 6 shows the composition of back-side primer. In the present example, the proportion of strontium chromate is 35 wt %. FIG. 7 shows the composition of back-side top coat. For the top coat a paint is used having a polyester content of 70 wt %. FIG. 8 shows the composition of a front-side primer. For this primer is used a paint having a 28 wt % zinc phosphate content. FIG. 9 shows the composition of front-side top coat. This top coat contains 60 wt % tetrafluoroplastic; therefore, it is not liable to staining by food and has good cleanability.

Figure 5:
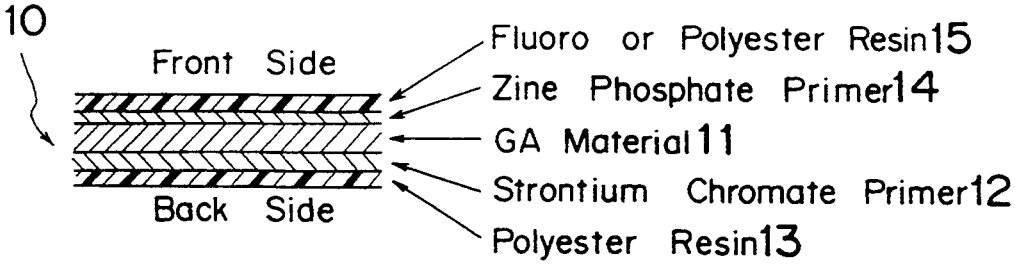
FIG. 5 is a view showing the material configuration of a PCM sheet steel used in a first embodiment according to the present invention.

FIG. 5 shows the material configuration of the PCM sheet steel 10. The metal body of this PCM sheet steel 10 consists of an iron/zinc alloyed, surface treated sheet steel (GA or galvanized alloy material) 11. On the back side of the metal body sheet are applied a strontium chromate primer 12 of the composition shown in FIG. 6 and a polyester resin top coat 13 of the composition shown in FIG. 7. On the front side of the metal body sheet 11 are applied a zinc phosphate primer 14 of the composition shown in FIG. 8 and a fluoroplastic or polyester resin top coat 15 of the composition shown in FIG. 9.

The corrosion resistant characteristics of the PCM sheet steel 10 are shown in FIGS. 10 and 11. FIG. 10 shows the results of corrosion resistance tests carried out with pieces of 0.4 mm to 2.0 mm in thickness for time periods of 240 to 1000 hrs. FIG. 11 shows the results of corrosion resistance tests carried out with pieces, 4 mm thick, having strontium contents of from zero to 35 wt %, for time periods of 240 to 1000 hrs. In FIGS. 10 and 11, mark denotes "normal," Δ denotes "slightly swollen," and × denotes "occurrence of red rust." It may be appreciated from FIG. 10 that the thickness of PCM sheet steel 10 is preferably not more than 0.8 mm. Also, it can be seen from FIG. 11 that a strontium chromate content of not less than 18 wt % is preferred.

Figure 3:
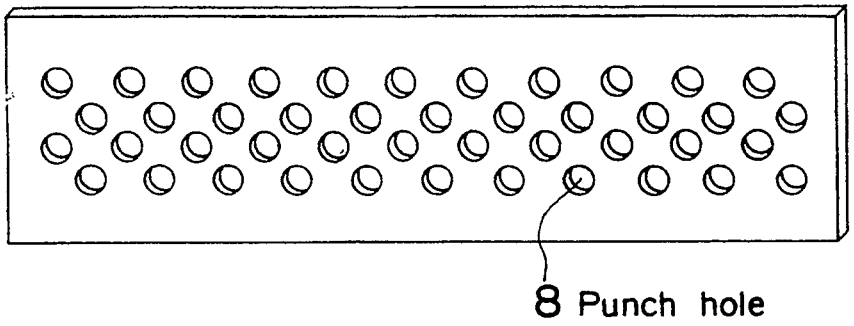
FIG. 3 is a fragmentary perspective view showing a wall portion formed with punch holes in the internal chamber.
Figure 4:
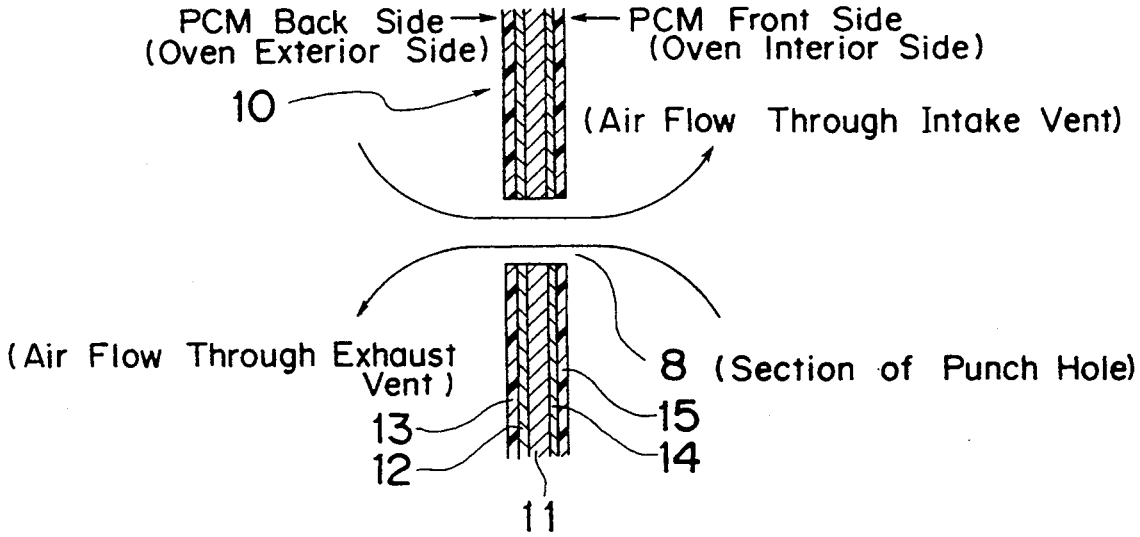
FIG. 4 is a view showing the condition of air streams in the vicinity of the punch holes.

The internal chamber 5 has an intake vent 2 and an exhaust vent 1 as already stated. These vents 1 and 2 consist of sets of punch holes of 3 to 3.5 mm in diameter each as shown in FIG. 3. When food heating is effected in the microwave oven, flow of air streams within the microwave oven is as shown in FIG. 4. Outside air passes through punch holes 8 from the back side of the PCM sheet steel 10 toward the front side, while vapor produced from the foodstuff passes through punch holes 8 from the front side of the PCM sheet steel 10 toward the back side. A location adjacent to the intake vent 2 is under the same condition as the atmospheric condition and, therefore, is under a condition close to the atmospheric condition in both temperature and humidity; thus, the punch holes 8 are kept in a satisfactory corrosion-resisting atmosphere. While, on the other hand, a location adjacent to the exhaust vent 1 (more particularly, the inner side thereof) is exposed to hot and humid conditions and is in a corrosive environment, by virtue of the strontium chromate primer 12 applied on the back side, the neighborhood of the punch holes 8 are prevented from rusting and, even if a trace amount of strontium chromate elution should occur at the inner end of the vent, it will not enter the interior of the internal chamber 5 because air streams are outward oriented; thus, the interior of the internal chamber 5 is kept in sanitarily safe condition.

Second Embodiment

The microwave oven of this second embodiment is different from the microwave oven of the above described first embodiment only in paint specifications with respect to a PCM sheet steel of which the internal chamber walls are constructed. In other respects, the arrangement of the microwave oven is similar to that of the previously described one.

Figures 12, 13, 14:
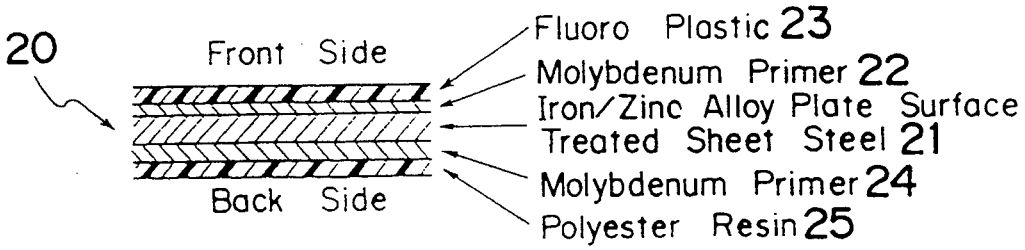
FIG. 12 is a view showing the material configuration of a PCM sheet steel used in a second embodiment according to the present invention.
FIG. 13 is a table showing a post-baking composition of the primer on the back side of the PCM sheet steel.
FIG. 14 is a table showing a post-baking composition of the primer on the front side of the PCM sheet steel.

The material configuration of the PCM sheet steel used in the present embodiment is shown in FIG. 12. The PCM sheet steel 20 comprises a molybdenum primer 22 applied to the front side of an iron/zinc alloy plated, surface treated sheet steel 21, with a fluoroplastic top coat 23 applied to the molybdenum primer 22. On the back side of the sheet steel 21 is applied a molybdenum primer 24, with a polyester resin top coat 25 applied to the molybdenum primer 24. That is, the PCM sheet steel 20 of FIG. 12 is different only in primer material from the PCM sheet steel 10 of FIG. 5, and is identical with the latter in respect of sheet metal material and top coat material.

FIG. 13 shows the composition of the molybdenum primer 24 applied to the back side. The proportion of zinc molybdate in the molybdenum primer is 35 wt %. FIG. 14 shows the composition of the molybdenum primer 22 applied on the front side. The proportion of zinc molybdate in this molybdenum primer 22 is 28 wt %.

FIG. 15 shows results of corrosion resistance tests carried out with a 0.4 mm thick PCM sheet steel 20 having a back-side molybdenum primer 24 of 3μ in thickness, with the thickness of the front-side molybdenum primer 22 varied from 1μ to 15μ, for time periods of 240 hrs to 1000 hrs. FIG. 16 shows results of corrosion resistance tests carried out with the PCM sheet steel 20, with the molybdenum primer rust preventive material changed in various ways. In FIGS. 15 and 16, mark denotes "normal," Δ denotes "slightly swollen," and × denotes "occurrence of red rust." It may be said from FIG. 15 that where the back-side molybdenum primer 24 of FIG. 13 composition is 3μ thick, the thickness of the front-side molybdenum primer 22 of FIG. 14 composition is preferably not less than 5μ. Also, it can be seen from FIG. 16 that zinc molybdate has as good corrosion resistance as strontium chromate. Zinc molybdate is a rust preventive material that is harmless from the standpoint of food sanitation and, therefore, even if there should occur a trace amount of zinc molybdate elution, it will involve no problem whatever from the food sanitation standpoint. Considering from the standpoints of corrosion resistance and food sanitation, it may be said that molybdenum primer is superior to strontium chromate primer.

In the above embodiment, an iron/zinc alloy plated, surface treated sheet steel is used as a sheet metal material, but it is noted that an iron/zinc non-alloy plated, surface treated sheet steel may be used instead. Other material of the like nature may also be used. Also, in the above embodiment, the molybdenum primer is applied to both sides of the sheet steel, but the molybdenum primer may be applied to only one side of the sheet steel.

As is apparent from the foregoing description, the microwave oven according to the present invention involves no problem whatever from the standpoints of corrosion resistance and food sanitation. Further, the arrangement of the present invention permits the internal chamber to be formed only by pressing and without post-painting being required. This provides for simplification of the fabrication process thereof and considerable cost reduction, with an added advantage of stable quality production. On the equipment side, the invention eliminates the need for equipment for post-molding painting, which in turn, eliminates the need for measures for environmental protection, with the result of considerable indirect cost saving.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A microwave oven comprising:

an internal chamber having walls comprised of a precoated sheet steel, wherein the precoated sheet steel includes a sheet steel, a first paint comprising strontium chromate dispersion-mixed with a resin and being applied to only one side of the sheet steel as a primer, said one side of the precoated sheet steel constitutes exterior surfaces of the walls of the internal chamber, a second paint applied over the primer, and a paint which is different than said first paint, applied over the other side of the sheet steel, said other side of the precoated sheet steel constitutes interior surfaces of the walls of the internal chamber; whereby the paints preventing corrosion of the microwave oven walls.

2. The microwave oven as set forth in claim 1, wherein a proportion of strontium chromate in a composition of the primer after baking of the primer is not less than 20 wt %.

3. A microwave oven comprising:

an internal chamber having walls of a precoated sheet steel, wherein the precoated sheet steel includes a sheet steel, a paint comprising molybdenum pigment dispersion-mixed with a resin and being applied to both sides of the sheet steel as a primer, and paints applied over the primer of the both sides of the sheet steel wherein the sheet steel is an iron/zinc alloy plated, surface treated sheet steel.

4. A microwave oven comprising:

an internal chamber having walls of a precoated sheet steel, wherein the precoated sheet steel includes a sheet steel, a paint comprising molybdenum pigment dispersion-mixed with a resin and being applied to one side of the sheet steel as a primer, a paint applied over the primer, and a paint applied over the other side of the sheet steel wherein the sheet steel is an iron/zinc alloy plated, surface treated steel sheet.

* * * * *